United States Patent [19]

Ebisawa et al.

[11] 4,268,162

[45] May 19, 1981

[54] ELECTROGRAPHIC COPYING APPARATUS

[75] Inventors: Kiyohito Ebisawa, Tokyo; Satoshi Hisabayashi, Hachioji; Kazuyuki Hashimoto, Hachioji; Mitsuo Kuromori, Hachioji; Toshio Koike, Hachioji, all of Japan

[73] Assignee: Iwatsu Electric Co., Ltd., Tokyo, Japan

[21] Appl. No.: 32,250

[22] Filed: Apr. 23, 1979

[30] Foreign Application Priority Data

Apr. 25, 1978 [JP] Japan ..... 53/48327
Apr. 25, 1978 [JP] Japan ..... 53/54169[U]

[51] Int. Cl.[3] ..... G03G 15/00
[52] U.S. Cl. ..... 355/14 R; 355/10; 355/14 SH; 355/3 SH
[58] Field of Search ..... 355/14 R, 14 SH, 3 SH, 355/16, 10, 13 R

[56] References Cited

U.S. PATENT DOCUMENTS

| | | | |
|---|---|---|---|
| 3,330,179 | 7/1967 | Zerfahs et al. | 355/14 SH |
| 3,533,691 | 10/1970 | Suzuki et al. | 355/13 |
| 3,743,406 | 7/1973 | Komori et al. | 355/14 SH |
| 3,762,813 | 10/1973 | Fowlie et al. | 355/14 SH |
| 3,856,396 | 12/1974 | Kushima et al. | 355/14 SH |

*Primary Examiner*—R. L. Moses
*Attorney, Agent, or Firm*—Merchant, Gould, Smith, Edell, Welter & Schmidt

[57] ABSTRACT

An electrographic copying apparatus which includes a paper feeding device, a charging device, an exposure device, a developing device including a developing vessel, a developer feed pump, and pressure rollers, and a paper conveyor, wherein each operational device is operated in a predetermined sequence, the original to be copied can be easily set into place, photographic papers of various sizes are usable, the developer can easily be replenished, and a pressing roller can be easily removed when desired.

4 Claims, 8 Drawing Figures

Fig. 6
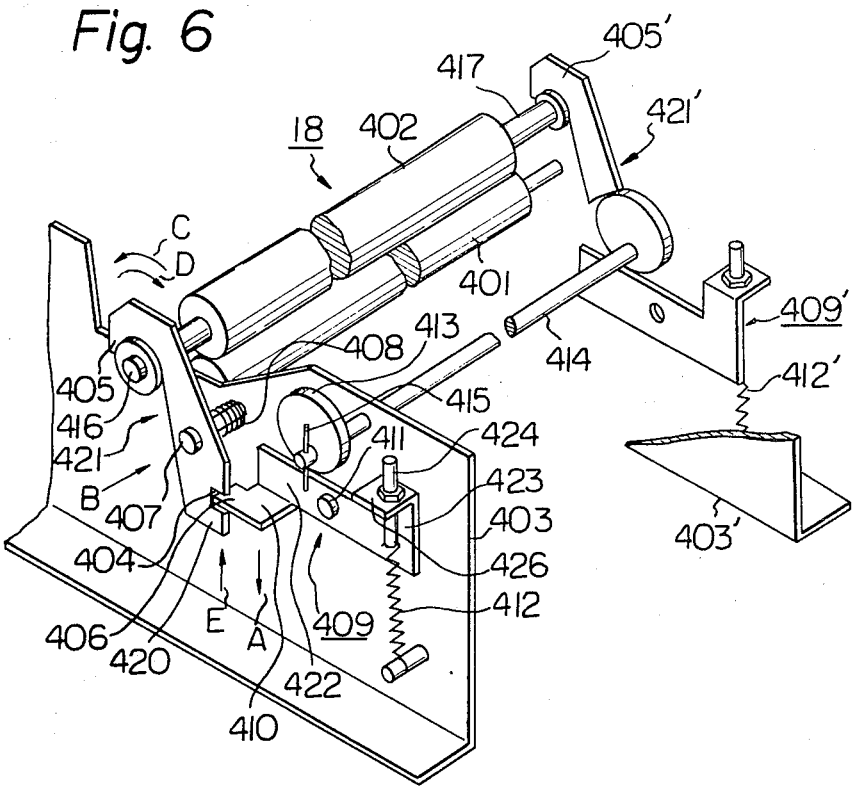
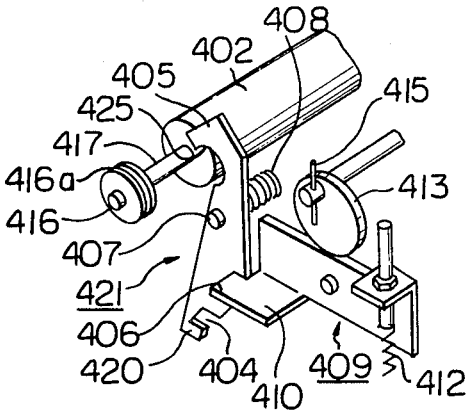
Fig. 7

ELECTROGRAPHIC COPYING APPARATUS

BACKGROUND OF THE INVENTION

The present invention relates to an electrographic copying apparatus, and more particularly, it relates to a wet type electrographic copying apparatus which uses liquid developer.

A wet type electrographic copying apparatus comprises: a paper feeding device which inserts a photosensitive paper into the apparatus; a charging device which charges the paper surface; an exposure device which exposes the paper corresponding to an original; a developing device which comprises a developer vessel, a developer feed pump and pressing rollers for removing excessive developer from the paper; and a paper conveyer device. In the conventional wet type electrographic copying apparatus, each device is caused to start to operate simultaneously with the other devices by a start signal, and is controlled individually regardless of the condition of the other devices. For example, the photosensitive paper is exposed immediately after it is transferred to the exposure position without a delay, thereby causing a blur of the image caused by the vibration of the conveyor belt due to its elasticity. During operation, the liquid developer is always circulated by the feed pump, causing a large evaporation loss. In addition, it is not easy to replenish or exchange the developer, because the feed pump is fixed within the developer vessel.

A prior art mechanism of the pressing rollers of the developing device is illustrated in FIG. 8. In FIG. 8, a lever 31 is pivotablly mounted on each side wall 30. The lever 31 has two arms 31*a*, 31*b*. The arm 31*a* engages with one of roller shafts 32. The other arm 31*b* is connected to a spring 33. In this arrangement, a pair of rollers 34, 34' are pressed against each other by the pulling force of the spring 33. An eccentric roller 35, which engages with the lever 31, is arranged on each side wall 30. The rollers 34, 34' are released from the spring force by rotating the eccentric roller 35 so as to rotate the lever 31 in the direction P when the paper is jammed between the rollers 34, 34' or the rollers are taken out of the apparatus for repair or cleaning. However, the lever 31 must be shifted against the spring force over a relatively large range in order to take out the rollers 34, 34'. Accordingly, the dimensions of the eccentric roller 35 must be large and it is not easy to rotate such a large eccentric roller against the force of the spring 33.

SUMMARY OF THE INVENTION

An object of the present invention is to obviate the above mentioned drawbacks of the conventional copying apparatus.

Another object of the present invention is to provide an electrographic copying apparatus wherein a clear image is always obtained, each operational portion is properly controlled so as to be operated in a predetermined sequence, the original can be easily set in a proper position, photosensitive papers of various sizes can be used, the developer can be easily replenished, and pressing rollers of the developing device can be easily taken out of the apparatus.

An electrographic copying apparatus according to the invention comprises:

(a) a paper feeding device which inserts a photosensitive paper, stored within a paper box, into the copying apparatus;
(b) a charging device which charges the paper surface;
(c) an exposure device which exposes the paper corresponding to an original;
(d) a paper detector arranged at an inlet for the photosensitive paper;
(e) a developing device comprising a developer vessel, a developer feed pump and pressing rollers for removing the excessive developer from the paper;
(f) a paper conveyor which conveys the exposed paper to the developing device, and;
(g) a control device comprising a plurality of switching means which are arranged to be actuated in sequence in response to a signal from the paper detector.

In the present invention, the developer feed pump, the paper conveyor and the exposure device are respectively connected to a corresponding switching means of the control device, so as to be actuated by the control device. In the arrangement according to the present invention, the developer feed pump can be easily taken out of the developer vessel, and the paper can be supplied either automatically or manually. The pressing mechanism of the pressing rollers of the developing device according to the present invention comprises a first lever and a second lever, each of which has two arms, wherein an arm of the first lever engages with a roller shaft, the other arm of the first lever engages with an arm of the second lever, and the other arm of the second lever is connected to a spring, whereby the spring force is transmitted to the roller shaft. The pressing mechanism further comprises a cam means for disengaging the first and the second levers. The cam means is arranged on the second lever. The first lever can shift to a position in which it does not obstruct the rollers when the rollers are to be taken out of the device after disengagement of the two levers by the cam means.

BRIEF DESCRIPTION OF THE DRAWINGS

FIG. 6 is a schematic perspective view of a pressing mechanism of the pressing rollers of the developing device according to the present invention.

FIG. 7 is a perspective view of the pressing mechanism in a release position.

DETAILED DESCRIPTION OF PREFERRED EMBODIMENTS OF THE INVENTION

Figure 1:
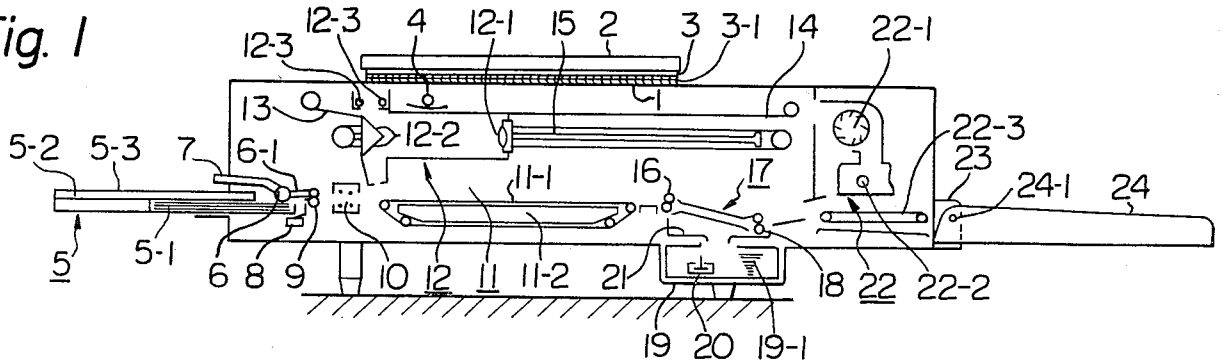
FIG. 1 is a schematic view of a construction of the copying apparatus according to the present invention.

An embodiment of the present invention is illustrated in FIG. 1. In FIG. 1, sheet of original guide film 3 is arranged between an original positioning plate 1 of transparent glass and a cover 2 of flexible material. 3-1 designates an original. Photosensitive papers 5-1 are stacked in a box 5. A cap 5-2 of the box 5 has a paper guide 5-3 for inserting the paper manually. An automatic paper feed roller 6, which is connected to a motor (not shown), is mounted on a support member 6-1 which has a change lever 7 thereon. A paper detector 8, first paper feed rollers 9 and an electric charger 10 are arranged in front of a paper conveyor 11. The paper conveyor 11 comprises a conveyor belt 11-1 and a vacuum box 11-2. An exposure device 12 comprises an optical lens 12-1, a mirror 12-2, two exposure lamps 12-3, another lamp 4 for lighting the original while it is being positioned, a shield belt 13 and another shield belt 14. The exposure device 12 moves reciprocally along a guide bar 15. A developing device 17 comprises second feed rollers 16, pressing rollers 18, a developer vessel 19, a developer feed pump 20 and a tray 21. The feed pump 20 supplies liquid developer 19-1 within the vessel 19 to the paper transported through the feed rollers 16. The liquid developer is returned to the vessel 19 by the tray 21. A heating device 22 comprises a heating fan 22-1, a heater 22-2 and a discharge belt 22-3. A paper receiver 24 is mounted on a holder 23 through a pivot shaft 24-1.

The apparatus operates as follows. First, an electrical power switch is turned on so that the lamp 4 lights under the original positioning plate 1. The cover 2 is opened in the direction of an arrow B in FIG. 2. An original 3-1 is put on the positioning plate 1 so that the copy side of the original is facing downwards. The lamp 4 lights the original 3-1 from underneith. Therefore, the image of the original can be seen through the original paper from above. The original 3-1 can be positioned correctly by aligning the image with the datum line of the guide film 3. Then, the cover 2 is closed, which completes the inserting of the original in the apparatus. When a copy button (not shown) is pressed, the feed roller 6 rotates at a predetermined regular speed, so as to transport the uppermost photosensitive paper 5-1 within the box 5 toward the first feed rollers 9. The front end of the transported paper 5-1 actuates the paper detector 8, so that the exposure device 12 starts to move toward the right, in FIG. 1, and the lamp 4 is turned off. The paper 5-1 is transported by the feed rollers 9 to the charger 10, where the paper surface is charged, then to the paper conveyor 11, where the paper is conveyed by the conveyor belt 11-1. When the rear end of the paper has passed the paper detector 8, the control device illustrated in FIG. 3 starts to operate. The operation of the control device will be described in detail later. A first signal of the control device stops the conveyor belt 11-1 after a predetermined time, so that the paper stops at a predetermined place. A second signal of the control device actuates the developer feed pump 20, so that the liquid developer 19-1 wets the pressing rollers 18 and returns into the vessel through the tray 21. The exposure device 12 has by this time already reached the right end of the guide bar 15. The exposure lamps 12-3 are turned on by a third signal of the control device emitted after a predetermined time from the time the paper has stopped. A fourth signal emitted after a predetermined time actuates the exposure device 12 so as to move it leftward, in FIG. 1. During this movement, the image of the original 3-1 is reflected on the photosensitive paper through the mirror 12-2 and the optical lens 12-1. At this time, an electrostatic latent image is formed on the charged paper. When the exposure device 12 has reached the leftward end of its movement, in FIG. 1, the exposure process has been completed and the exposure lamps 12-3 are turned out while the lamp 4 is turned on. Then, the conveyor belt 11-1 transports the exposed paper to the developing device 17 where the electrostatic latent image is developed and turned into a visible image by the liquid developer. The liquid developer remaining on the paper is removed by the pressing rollers 18. The paper is, then, conveyed to the heating device 22 where it is dried by the fan 22-1 and the heater 22-2. Then, the paper is discharged into the receiver 24 by the discharge belt 22-3. After that, a fifth signal of the control device is emitted so as to stop the pump 20, so that the circulation of the developer is stopped. This completes one operational cycle of the apparatus.

Figure 4:
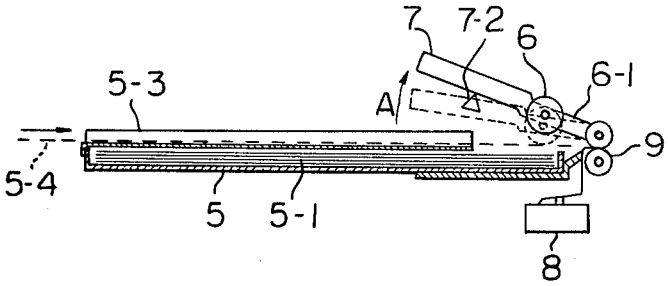
FIG. 4 is an enlarged view of the paper feeding device illustrated in FIG. 1.

In the copying apparatus according to the present invention, various sizes of photosensitive paper can be inserted into the apparatus manually. In such a case, the change lever 7 is moved upward as indicated by an arrow A in FIG. 4, until it reaches a support 7-2, which supports the lever 7 with the automatic feed roller 6 in this upper position, so that a passage for manual insertion of the paper is formed under the roller 6. Therefore, paper 5-4 of various sizes can be inserted through the guide 5-3 for manual insertion of the paper. The manually inserted paper actuates the paper detector 8 and reaches the feed rollers 9. After that, the apparatus treats the paper in the same way as in the aforementioned operational cycle.

Figure 2:
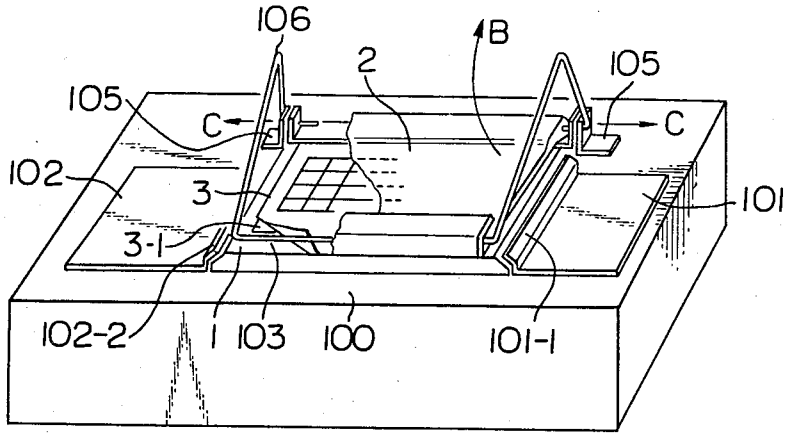
FIG. 2 is a perspective view of an original positioning portion of the copying apparatus according to the present invention.

The position of the original is illustrated in detail in FIG. 2. The original positioning plate 1 of transparent glass is located on a body frame 100 and held by inclined ends 101-1 and 102-2 of holder plates 101 and 102, respectively. The cover 2 is pivotably mounted on a metallic frame bar 106 which is supported by support 105. Datum lines are marked on guide film 3. If a thick original is to be copied, the cover 2 and the guide film 3 are easily removed by pulling out the metallic frame bar 106 from the support 105 in the direction of arrows C.

Figure 3:
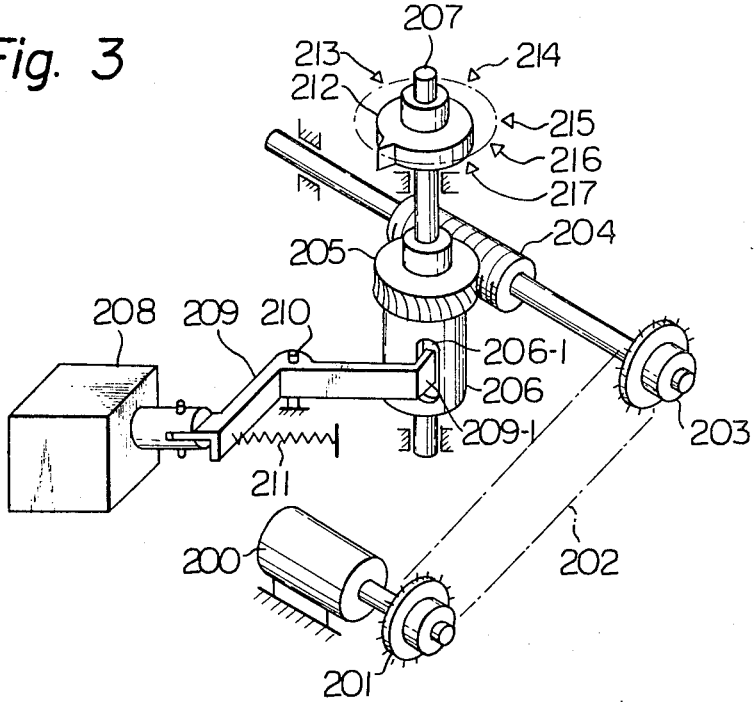
FIG. 3 is a schematic view of a construction of the control device according to the present invention.

An example of the control device is illustrated in FIG. 3. A gear 201 is fixed to an output shaft of a drive motor 200. Another gear 203 is fixed to a shaft of a worm 204. Both gears 201 and 203 are connected by a chain 202. A worm wheel 205, a clutch 206 and a solenoid 208 for the clutch 206 are positioned as depicted in FIG. 3. A lever 209 is actuated by the solenoid 208, so as to rotate about an axis 210. A return spring 211 is engaged with the lever 209. A control cam 212 is installed on an output shaft 207 of the clutch 206. Five contacts 213 through 217 are arranged at predetermined positions arround the control cam 212. A projection of the cam 212 engages with the contacts 213 through 217 in sequence so as to emit the first through fifth signals in turn. When the paper detector 8 (FIG. 1) detects the rear end of the photosensitive paper, the detector sends a signal to the solenoid 208 so that it is energized. This causes the lever 209 to rotate about the axis 210, so that a hook 209-1 formed at the end of the lever 209 is pulled out of a recess 206-1 of the clutch 206. As a result, the clutch 206 operates so as to transmit the rotation of the worm wheel 205 to the output shaft 207 so that the cam 212 is rotated. The projection of the cam 212 contacts each contact 213 through 217 in a predetermined sequence so as to emit the first through fifth signals. Before the cam has completed one revolution, the solenoid is deenergized so as to restore the lever 209 by the force of the return spring 211, so that the hook 209-1 engages with the recess 206-1 after the cam has rotated one turn. In this condition, the clutch 206 separates the connection between the worm wheel and its output shaft, so that the rotation of the worm wheel transmitted from the motor 200 through the worm 204, gears 201, 203 and the chain 202 is not transmitted to the output shaft 207. Therefore, the cam is stopped after one revolution.

Figure 5:
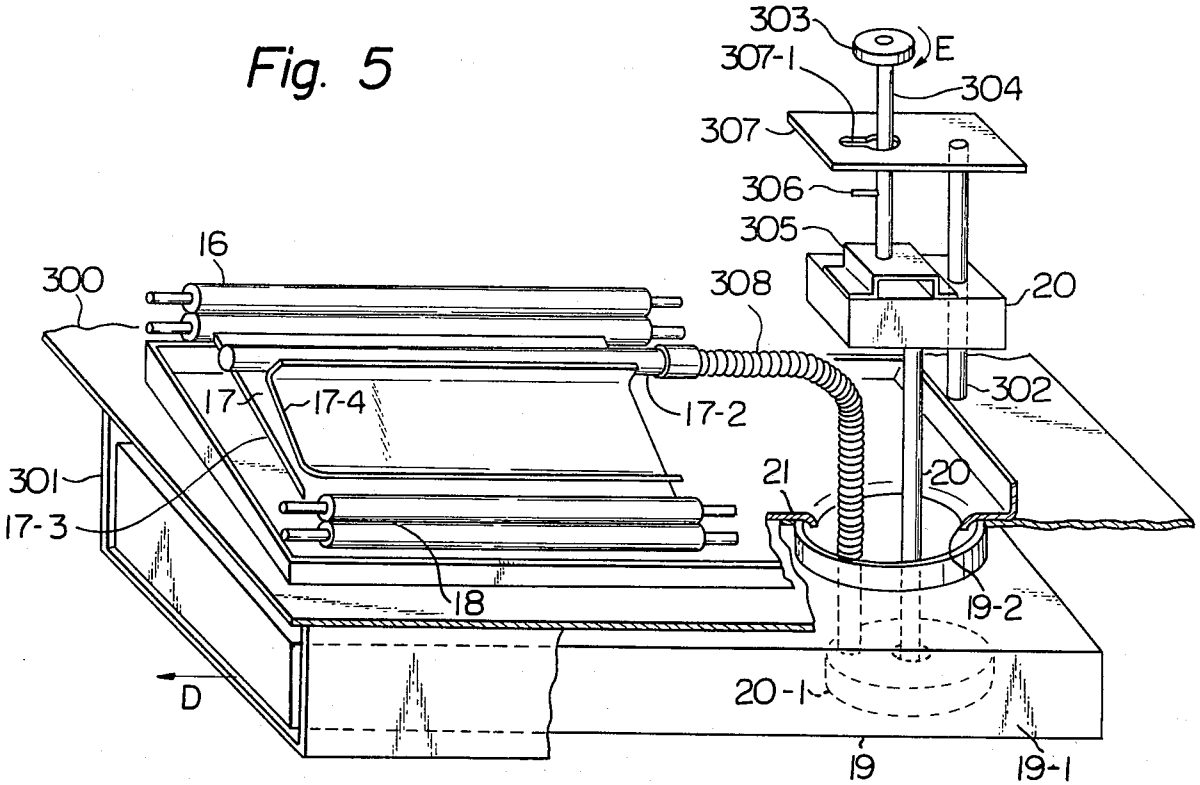
FIG. 5 is a perspective view of a developing device according to the present invention.
Figure 8:
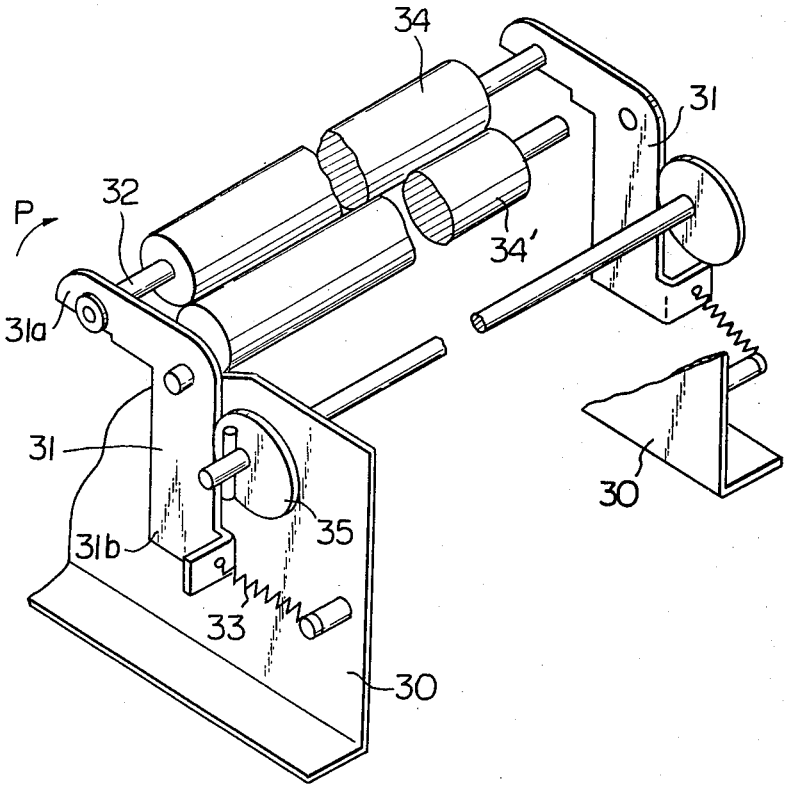
Fig. 8 PRIOR ART
FIG. 8 is a schematic perspective view of a pressing mechanism of prior art.

The developing device is illustrated in detail in FIG. 5. An outer frame 301 for housing the developer vessel 19 is secured to the underside of a body frame 300. A guide rod 302 along which the pump 20 can move up and down is mounted on the body frame 300. A rod 304 for lifting the pump 20 is rotatably installed on a bracket 305 of the pump 20. A knob 303 is fixed to the top of the rod 304. In the middle of the rod 304, a projection 306 is mounted. A pump support plate 307 is mounted on the top end of the guide rod 302. The support plate 307 has a through hole 307-1, the size of which corresponds to the size of the projection 306 and the diameter of the rod 304. One end of a flexible pipe 308 is connected to a pump head 20-1, while the other end is connected to a developer feed pipe 17-2. 17-3 designates a lower guide plate and 17-4 an upper guide plate. The developing device operates as follows. The pump 20 is actuated by the second signal from the control device, so that the developer 19-1 within the vessel 19 is fed to the feed pipe 17-2 through the flexible pipe 308 from the pump head 20-1. The developer flows between the upper and lower guide plates 17-3 and 17-4 and wets the pressing rollers 18. Then, the developer collects in the tray 21 and returns to the vessel 19 through the outlet of the tray 21. The photosensitive paper which has the electrostatic latent image formed thereon and has been transported to the developing device through the rollers 16 is developed while passing between the guide plates 17-3 and 17-4. The developed paper passes through the pressing rollers 18, which remove the excessive developer remaining on the paper. The paper is, then, transported to the heating device for drying. When the developer is to be exchanged, the rod 304 is moved upward, in FIG. 5, with the pump 20, which is connected to the rod 304, so that the undersurface of the pump head 20-1 is shifted to the position shown above the circulated developer inlet 19-2. This causes the projection 306 of the rod 304 to be shifted to a position above the support plate 307. Then, the knob 303 is rotated in the direction indicated by an arrow E, so as to support the projection 306 on the plate 307. Accordingly, the pump 20 and the pump head 20-1 are held above the vessel 19. In this condition, the developer vessel 19 can be drawn out of the outer frame 301 in the direction of an arrow D, so that the developer can be easily exchanged.

An example of the pressing mechanism of the pressing rollers 18 is illustrated in FIG. 6 and FIG. 7. The pressing rollers 18 comprise a pair of rollers 401, 402, which are rotatably and removably mounted on the side walls 403 and 403' of the apparatus body. A first lever 421 and a second lever 409 are pivotably mounted on a shaft 407 and a shaft 411, respectively, on the outside of the side wall 403. The other side wall 403' has the same arrangement of the pressing mechanism as the side wall 403. However, this description will be directed to only one of the side walls. A roller 416, which has a annular groove on its outer surface, is installed on a shaft 417 of the roller 402. An arm 405 of the first lever 421, which has a semicircular recess 425 (FIG. 7) on its end portion, engages with the groove 416a of the roller 416. A notch 404 is formed on the other arm 420 of the first lever 421. A coil spring 408 is arranged around the shaft 407 between the first lever 421 and the side wall 403, so as to push the lever 421 toward outside until it abuts against a stopper (not shown). An arm 422 of the second lever 409 has a horizontal tongue 406. The tongue 406 engages with the notch 404 of the first lever 421. Another horizontal tongue 426 is formed on the other arm 423 of the second lever 409. A rod 424 is fixed to the tongue 426. The rod 424 is connected to one end of a spring 412. The other end of the spring 412 is fixed to the side wall 403. An eccentric roller 413, which can contact the arm 422 of the second lever 409 is installed on a shaft 414. A pin 415 for manually rotating the eccentric roller 413 is mounted at an end of the shaft 414.

The above mentioned pressing mechanism operates as follows. Under normal conditions, that is during the operation of the copying apparatus, the small radius portion of the eccentric roller 413 is positioned so that it is the lower portion of the roller, as illustrated in FIG. 6, so that the eccentric roller 413 does not contact the second lever 409. Therefore, the tongue 406 of the second lever 409 abuts against the upper edge of the notch 404, so as to push the arm 420 in the direction of an arrow E due to the force of the spring 412. The arm 405 of the first lever 421 rotates in the direction of an arrow C so that the semiconductor recess 425 engages with the annular groove 416a of the roller 416, so as to depress the roller 402 toward the roller 401.

When the pressing roller 402 is to be removed for repair or other reason, the eccentric roller 413 is rotated, by depressing the arm 422 downward against the force of the spring 412, by manually moving the pin 415 until the large radius portion of the eccentric roller 413 is shifted to the lower portion of the roller, as illustrated in FIG. 7. Therefore, the tongue 406 of the second lever 409 moves downward, in the direction of an arrow A in FIG. 6, and disengages from the upper edge of the notch 404 of the first lever 421, so that the force of the spring 412 is not transmitted to the first lever 421. Then, the first lever 421 is manually moved toward the side wall 403 against the force of the spring 408 until the lever 421 is shifted away from the tongue 406. After that, the first lever 421 is rotated in the direction of an arrow D, in FIG. 6, so that the end of the arm 405 is sufficiently moved away from the shaft 417 to take out the roller 402. As a result, the pressing roller 402 can be easily taken out of the apparatus without being obstructed by the pressing mechanism. The pressing roller can be replaced in the device by carrying out the above mentioned steps for removal of the roller in reverse order.

As mentioned previously, the electrographic copying apparatus according to the present invention, has many advantages over the connectional copying apparatus. The original can be positioned in the prescribed position with accuracy due to the guide film on which the datum lines are marked. Blurring of the image caused by the vibration of the conveyor belt due to its elasticity can be avoided, because the photosensitive paper is exposed after a predetermined time has elapsed from the time the conveyor belt has stopped by the function of the control device. The evaporation loss of the developer can be minimized, because the developer feed pump is not always driven but is actuated when the paper has reached a point near the developer device by the function of the control device. The minimization of the evaporation loss of the developer decreases the possiblity of a shortage of developer which should be supplied over the paper, which results in the clear and stable development of the image. The developer can be easiliy exchanged by lifting the feed pump out of the developer vessel and holding it on the support plate above the vessel, and then, drawing the vessel out of the developing device. The pressing roller of the developing device can be easily removed due to the construction of the present invention, in which two levers are arranged between the pressing roller and the spring which acts upon the roller through the two levers so as to depress the roller and in which the lever engaging the roller can be sufficiently moved away from the roller to allow the taking out of the roller from the device.

The present invention is not limited to the embodiments herein described with reference to the accompanying drawings, but can be modified into many variations thereof within the scope of claims.

What is claimed is:

1. An electrographic copying apparatus comprising:

(a) a paper feeding device which inserts a photosensitive paper, stored within a paper box, into the copying apparatus;

(b) a charging device which charges the paper surface;

(c) an exposure device which exposes the paper corresponding to an original;

(d) a paper detector arranged at an inlet for the photosensitive paper;

(e) a liquid developing device which comprises a developer vessel and a liquid developer feed pump;

(f) a paper conveyor which transports the exposed paper to the developing device; and (g) a control device comprising a plurality of switching means which are arranged to be actuated in sequence in response to a signal from the paper detector, in which said developer feed pump is connected to said control device so as to be actuated by one of said switching means.

2. An electrographic copying apparatus according to claim 1, in which a rod for lifting up said developer feed pump is provided on said pump, said rod has a projection for hanging the rod on a support member secured to the apparatus body, so that said pump can be held in a position above and out of said developer vessel.

3. An electrographic copying apparatus according to claim 1, in which said paper feeding device comprises an automatic feed roller which inserts an uppermost paper in said paper box into the apparatus through the paper inlet in response to a copy start signal and further comprises a supporting means which holds said automatic roller in a position away from said paper so that a paper can be manually inserted through said inlet.

4. An electrographic copying apparatus according to claim 1, in which a transparent guide film, on which datum lines are marked, is arranged between an original positioning plate and a cover.

* * * * *

UNITED STATES PATENT AND TRADEMARK OFFICE

CERTIFICATE OF CORRECTION

PATENT NO. : 4,268,162

DATED : May 19, 1981

INVENTOR(S) : Kiyohito Ebisawa, et al

It is certified that error appears in the above-identified patent and that said Letters Patent are hereby corrected as shown below:

Column 3, line 28, "underneith" should be --underneath--;

Column 4, line 48 "arround" should be --around--;

Column 6, line 51 "connectional" should be --conventional--;

Column 6, line 23, "semiconductor" should be --semicircular--.

Signed and Sealed this

*Eighteenth* Day of *August 1981*

[SEAL]

*Attest:*

GERALD J. MOSSINGHOFF

*Attesting Officer*

*Commissioner of Patents and Trademarks*